United States Patent [19]

Chapman et al.

[11] Patent Number: 4,843,771

[45] Date of Patent: Jul. 4, 1989

[54] WALL TRIM MEMBER

[75] Inventors: Robert M. Chapman, Lockport; Robert J. Menchetti, Buffalo, both of N.Y.

[73] Assignee: National Gypsum Company, Dallas, Tex.

[21] Appl. No.: 213,210

[22] Filed: Jun. 29, 1988

[51] Int. Cl.[4] ..... E04F 19/02

[52] U.S. Cl. ..... 52/288; 52/287; 52/718.1

[58] Field of Search ..... 52/277, 278, 279, 287, 52/288, 290, 282, 717, 716, 718

[56] References Cited

U.S. PATENT DOCUMENTS

| | | | |
|---|---|---|---|
| 1,250,594 | 12/1917 | Knapp | 52/287 |
| 1,539,537 | 5/1925 | Bates, Jr. | 52/280 |
| 2,255,736 | 9/1941 | Odell | 52/278 |
| 3,070,646 | 12/1962 | Lindgren | 52/277 |
| 3,228,165 | 1/1966 | Begian | 52/288 |
| 3,321,878 | 5/1967 | Brown et al. | 52/287 |
| 3,717,968 | 2/1973 | Olsen et al. | 52/288 |
| 3,899,859 | 8/1975 | Smith | 52/287 |
| 4,258,519 | 3/1981 | Hugens | 52/282 |
| 4,558,797 | 12/1985 | Mitchell | 52/282 |
| 4,642,957 | 2/1987 | Edwards | 52/288 |
| 4,671,026 | 6/1987 | Wissinger | 52/288 |

FOREIGN PATENT DOCUMENTS

| | | | |
|---|---|---|---|
| 563755 | 6/1960 | Belgium | 52/288 |
| 690554 | 7/1964 | Canada | 52/288 |
| 2049301 | 10/1979 | Fed. Rep. of Germany | 52/287 |
| 36570 | 10/1967 | Finland | 52/287 |
| 296285 | 4/1954 | Switzerland | 52/287 |
| 922613 | 4/1963 | United Kingdom | 52/278 |

*Primary Examiner*—Michael Safavi

*Attorney, Agent, or Firm*—Laird F. Miller; Robert F. Hause

[57] ABSTRACT

A wall in which at least one wall trim member has a face portion, spaced outwardly from the plane of the wallboard, and has an angled sidewall which, by its angled nature, tends to blend with both the wall trim face portion and the wallboard surface, which angled side wall is removed in short sections of this first wall trim member whereat a second wall trim member, with a face coplanar with the first wall trim member face portion, is abutted against the first wall trim member.

8 Claims, 2 Drawing Sheets

WALL TRIM MEMBER

BACKGROUND OF THE INVENTION

This invention relates to a novel wall trim member which blends simultaneously with both an adjacent wall panel and with adjacent floor and ceiling trim members, or any other adjacent trim members.

Wall trim members are commonly used, in constructing an inside wall, which trim members project outwardly a short distance from the plane of the wall, such as baseboards or floor trim, ceiling trim, door frames, window frames and outside corner trim members. Efforts are sometimes made to have the trim member blend in with the adjacent structural elements, as by painting the trim member with the same or a compatible color. This does not overcome the clear sharp break in the wall surface caused by the perpendicular side edge on the wall trim member.

Current flush trim designs do not provide for the termination of adjacent trim members. Typically, specially formed transitional components are required. Current trim designs that do not accommodate for terminating adjacent trims do not have a flush, and properly finished, appearance.

SUMMARY OF THE INVENTION

The present invention provides a wall trim member which has a narrow elongated angled edge to blend in with an adjacent wall panel.

In the preferred form of the invention, for use on an outside corner, formed by two perpendicular walls, the trim member consists of an elongate, rigid, thin vinyl body, formed in a cross-section which includes a central, elongate, curved corner portion, bordered on each side with attachment means and an inwardly angled, dual-blending side wall.

The attachment means have a thickness which is sufficient to place the trim member face in a spaced relation, from the plane of the wall, a distance equal to the amount the adjacent floor trim or ceiling trim protrudes out from the wall. Portions of the angled side wall are removed where the trim member abuts the floor trim or the ceiling trim, whereby the trim member appears monolithic with respect to the floor and ceiling trim, while portions between the floor trim and ceiling trim appear to blend in with the wall surface, by reason of the dual-blending angled side wall.

Preferably, the trim member is made of the same material as the floor and ceiling trim. When the trim member is used with fabric faced wallboard, the portion of the trim member located above the floor trim and below the ceiling trim is covered with fabric which is similar to the wallboard fabric, producing a monolithic appearing continuous fabric surface extending from one wallboard around the corner to another wallboard.

It is an object of the present invention to provide a novel wall trim member which blends into the two spaced apart surfaces of a wallboard and the more outwardly disposed trim members such as floor and ceiling trim members.

It is a further object of the invention to provide an elongate trim member having a novel dual-blending angled side wall which is suitable for removal from portions of the trim member which abut against other trim members.

BRIEF DESCRIPTION OF THE DRAWINGS

These and other objects and advantages will be more readily apparent when considered in relation to the preferred embodiments of the invention as set forth in the specification and shown in the drawings in which.

DESCRIPTION OF THE PREFERRED EMBODIMENTS

Figure 1:
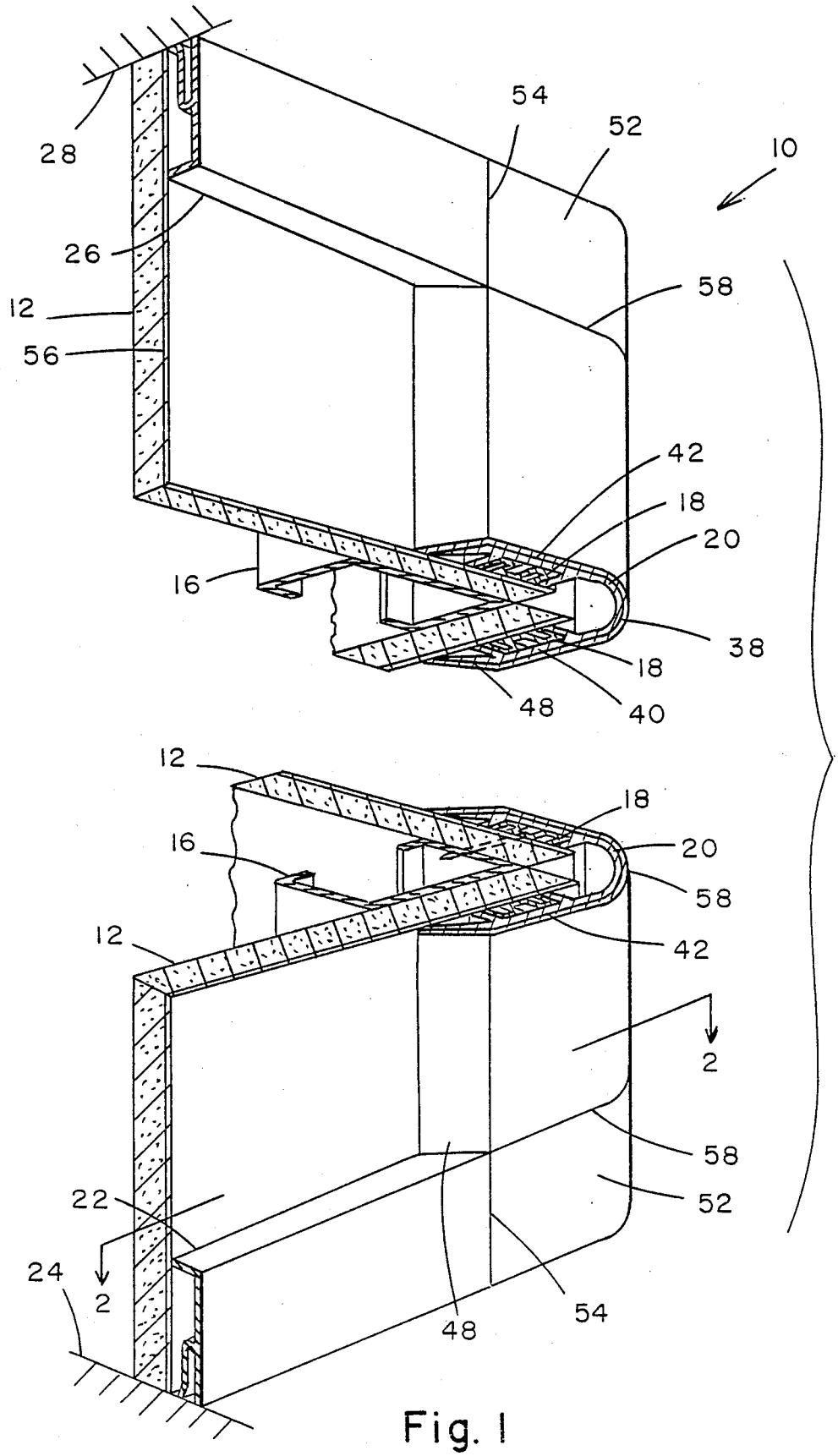
FIG. 1 is a perspective view of the bottom and top portions of an outside corner of a wall including, at the corner, a novel corner trim member having a dual-blending angled side wall.
Figure 2:
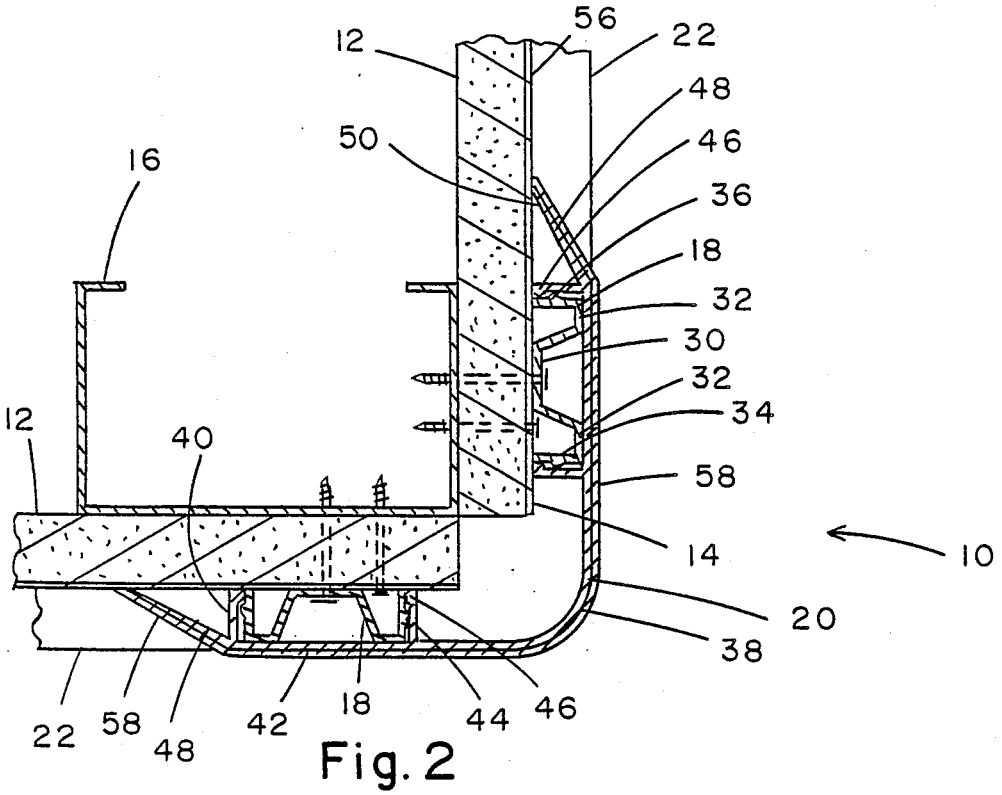
FIG. 2 is a top horizontal sectional view of the structure of FIG. 1, taken on line 2—2 thereof.

Referring to FIGS. 1 and 2, a wall corner 10 is shown in which two wallboards 12 have a vertical edge 14 of each screw-attached to a vertical metal screw stud 16. Wall batten receiver strips 18 are also screw-attached, over wallboard edges 14, to stud 16.

A novel rigid vinyl elongate corner trim member 20 is attached to the two receiver strips 18. A rigid vinyl elongate floor trim member 22 is mounted along the bottom of each of the wallboards 12 abutting the floor 24, and a rigid vinyl elongate ceiling trim member 26 is mounted along the top of each of the wallboards abutting the ceiling 28.

The strips 18 are standard receiver strips commonly used for mounting wall battens over wallboard joints. The receiver strips 18 are formed elongate metal strips having a concave recessed center 30 for the screw attachment, a pair of opposed raised shoulders 32 and a pair of rearwardly extending side walls 34. Side walls 34 each have an outwardly raised elongate ridge 36.

Corner trim member 20 is an elongate rigid vinyl extrusion including, in cross-section, a central, elongate, curved corner portion 38, which is approximately a 1/16 inch thick wall formed in a $1\frac{1}{2}$ inch radius extending laterally to provide a 90° arc. At each side edge of corner portion 38 is an attachment channel 40, which opens rearwardly, and includes a face wall 42 of about 1/16 inch thickness, and two parallel spaced rearwardly extending legs 44. Legs 44 are spaced apart just sufficiently to embrace the side walls 34 of strips 18. Legs 44 each have an elongate inwardly directed ridge 46 which interlocks behind a ridge 36 on strip 18, holding corner trim member 20 in place, on corner 10.

Corner trim member 20 further includes an elongate, angled, dual-blending side wall 48 extending toward the wallboard 12 from each face wall 42, forming a continuous surface with the face walls 42 and the corner portion 38.

Angled side walls 48 have a thickness of about 1/16 inch at the junction of the side walls 48 with the face wall 42. The angled side walls 48 have a tapered thickness, tapering to a very thin outer edge 50. The side walls extend at an angle of about 20°, or between about 10° and 30°, to the plane of the face wall 42.

The corner trim member 20 is originally formed by extruding rigid vinyl material, similar to the material of the floor and ceiling trim members 22, 26, with the angled side walls angled and extending to a plane which is slightly farther than the plane to which the side walls 34 extend, whereby when the corner trim member 20 is mounted on wallboards, the thin outer edge 50 of the angled side walls is caused to press slightly against the wallboards 12, and tend, somewhat, to appear monolithic with the wallboards 12.

Prior to mounting the corner trim member 20, the corner trim member 20 is cut from an elongate strip of the extruded rigid vinyl, in a length equal to the distance from the floor 24 to the ceiling 28. Next, a short section of each of the two angled side walls 48 is removed from each end portion 52.

The floor trim members 22 and the ceiling trim members 26 are each formed to extend out from the wallboards 12 exactly the same distance as the face wall 42 of the corner trim member 20. The floor trim members 22 and the ceiling trim members 26 are all terminated precisely to abut against the portion of face wall 42 at the end portion 52, whereat the angled side walls 48 have been removed. Consequently, with good workmanship, the junction 54 of the floor trim 22 or ceiling trim 26 with the face wall 42 is substantially indiscernible.

In the preferred embodiment, the wallboards 12 have a predecorated facing sheet 56. An identical predecorated facing sheet 58 is laminated onto the corner trim member 20, except in the two end portions 52. Consequently, the predecorated design of the wallboards 12 is continued around the corner, as is the surface appearance of the floor trim 22 and the ceiling trim 26.

Figure 3:
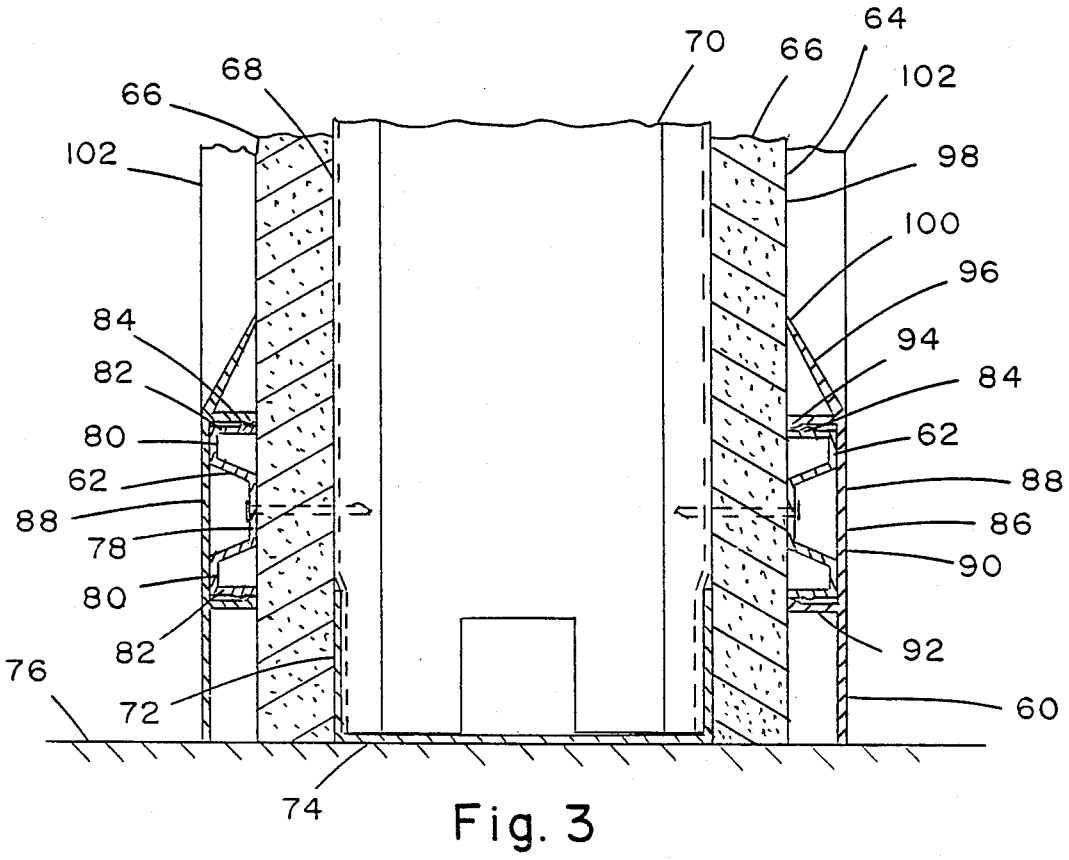
FIG. 3 is a vertical end sectional view of a base trim member having a dual-blending angled side wall, in accordance with the invention.

Trim members other than corner trim member 20 can also be made in accordance with the invention. FIG. 3 shows a modified base trim member 60, which is mounted on an elongate horizontally extending batten receiver strip 62. Strip 62 is screw attached to the face 64 of a wallboard 66, and wallboard 66 is affixed to the face 68 of vertical stud 70. Stud 70 is mounted within the side flanges 72 of a floor track 74, mounted along floor 76.

The batten receiver strip 62 includes a concave recessed center 78 for the screw attachment, a pair of opposed raised shoulders 80 and a pair of rearwardly extending side walls 82. Side walls 82 each have an outwardly raised elongate ridge 84.

The base trim member 60 is an elongate rigid vinyl extrusion including, in cross-section, a flat elongate face portion 86, which is essentially a 1/16 inch thick wall. Near the top of face portion 86 is an attachment channel 88 which opens rearwardly, and includes a face wall 90, which is part of face portion 86, and two parallel spaced rearwardly extending legs 92. Legs 92 are spaced apart just sufficiently to embrace the side walls 82 of strip 62. Legs 92 each have an elongate inwardly directed ridge 94 which interlocks behind a ridge 84 on strip 62, holding base trim member 60 in place, against the bottom of wallboard 66.

Base trim member 60 further includes an elongate angled, dual-blending side wall 96, which extends upwardly and rearwardly toward the surface 98 of the wallboard 66. The angled side wall has a thickness of about 1/16 inch at the junction with face wall 90 and tapers to a very thin outer edge 100. Thus dual-blending side wall 96 blends into the face wall 90 and into the surface 98 of wallboard 66.

A vertically extending wall trim member 102 extends down to the top of the face wall 90, at a portion of the base trim member 60 from which the side wall 96 has been removed, whereby the trim member 102 blends into the face portion 86 of the base trim member 60.

Having completed a detailed disclosure of the preferred embodiments of our invention so that those skilled in the art may practice the same, we contemplate that variations may be made without departing from the essence of the invention.

We claim:

1. A unitary wall trim member comprising an elongate flat face wall, said flat face wall lying entirely within a first plane, means behind said face wall suitable for attaching said trim member relative to a second plane having a space parallel relationship to said first plane, and an elongate angled dual-blending flat-surfaced side wall, said flat-surfaced side wall having a flat-surfaced side wall surface entirely in a third plane extending away from said flat face wall at an angle of between about 10° and 30° to said first plane, said flat-surfaced side wall surface extending, in width, from said first plane to said second plane, whereby said trim member face wall has a surface which is able to blend through said angled side wall surface into said second plane, and wherein said elongate angled side wall is shorter than said elongate face wall, whereby said face wall includes a portion having a side wall adjacent thereto and a portion with no adjacent side wall, which said portion with no adjacent side wall is able to be abutted in coplanar relationship to other similar or dissimilar wall trim members having an equal spaced relationship between a corresponding face wall and said second plane, and wherein said portion with no adjacent side wall has a surface appearance which is different from a surface appearance which is present on said angled side wall and on said portion having a side wall adjacent thereto, whereby said portion with no adjacent side wall is able to blend with trim members while said angled side wall and adjacent face portion is able to blend with material in said second plane.

2. A unitary wall trim member comprising an elongate flat face wall, said flat face wall lying entirely within a first plane, means behind said face wall suitable for attaching said trim member relative to a second plane having a spaced parallel relationship to said first plane, and an elongate angled dual-blending flat-surfaced side wall, said flat-surfaced side wall having a flat-surfaced side wall surface entirely in a third plane extending away from said flat face wall at an angle of between about 10° and 30° to said first plane, said flat-surfaced side wall surface extending, in width, from said first plane to said second plane, whereby said trim member face wall has a surface which is able to blend through said angled side wall surface into said second plane, and wherein said wall trim member is a rigid vinyl elongate corner trim member, said trim member including two elongate flat face walls disposed in perpendicular planes, said corner trim member further including a central elongate curved corner portion extending laterally to provide a 90° arc connecting said two flat face walls, each of said two flat face walls having an elongate angled dual-blending side wall extending away from said face wall at an inwardly directed angle of between about 10° and 30° to the plane of said face wall, and wherein said side walls are each shorter than said face walls and said corner portion, and wherein said face walls and said corner portion include two longitudinal end portions, said longitudinal end portions having no adjacent side walls and a portion therebetween having adjacent side walls, whereby said face walls and said corner portions at each said end are able to form a continuous surface with floor trim and ceiling trim of two perpendicular walls.

3. A wall trim member as defined in claim 2 wherein said face wall and corner portions with no adjacent side walls, at each said end of said wall trim member, have a different surface appearance than said portion therebetween having adjacent side walls.

4. A wall comprising wallboards and a first unitary wall trim member, said unitary wall trim member comprising an elongate flat face wall, said flat face wall lying entirely within a first plane, means behind said face wall suitable for attaching said trim member to a flat surface which is in a second plane having a spaced parallel relationship to said first plane, and an elongate angled dual-blending flat-surfaced side wall, said flat-surfaced side wall having a flat-surfaced side wall surface entirely in a third plane extending away from said flat face wall at an angle of between about 10° and 30° to said first plane, said flat-surfaced side wall surface extending, in width, from said first plane to said second plane, whereby said trim member face wall has a surface which is able to blend through said angled side wall surface into said second plane, said wallboards having an outer surface against which said dual-blending side wall is disposed, whereby said side wall surface blends with said wallboard surface, and further comprising a second wall trim member in addition to said first wall trim member, said second wall trim member having a face portion, said second trim member face portion being disposed in said first plane and also being disposed in abutting relation to a portion of said first trim face wall, said abutted portion of said first trim face wall being a portion which has no side wall adjacent thereto, and wherein said wall forms an outside corner and said first wall trim member is a corner trim member which provides protection to the wallboard edges disposed at said corner and provides enhanced aesthetics to said corner, said corner trim member having two elongate flat face walls disposed in respective perpendicular first planes, said corner trim member further having a central elongate curved corner portion extending laterally to provide a 90° arc connecting said two flat face walls, each of said two flat face walls having an elongate angled dual-blending side wall extending away from said face wall at an inwardly directed angle of between about 10° and 30° to the respective first planes of said walls.

5. A wall outside corner as defined in claim 4 wherein said side walls are each shorter than said face walls and said corner portion, wherein said face walls and said corner portion of said first wall trim member include two opposed longitudinal end portions, said face walls and corner portion having no adjacent side walls at, said end portions and wherein there are a plurality of said second wall trim members, said second wall trim members being floor trim members and ceiling trim members.

6. A wall outside corner as defined in claim 5 wherein said first wall trim member and said second wall trim members are all formed of similar rigid material and wherein a portion of said first wall trim member which includes side walls has a distinctive different surface appearance than a surface appearance of said second wall trim members and of said portions of said first wall trim member with no adjacent side wall.

7. A wall outside corner as defined in claim 6 wherein said first wall trim member and said second wall trim members are all formed of an extruded rigid vinyl.

8. A wall outside corner as defined in claim 7 wherein said wallboard and said portion of said first wall trim member with side walls are covered with a predecorated wallcovering material.

* * * * *